United States Patent [19]

Polsky

[11] 4,371,989

[45] Feb. 8, 1983

[54] SEAMLESS CROTCH

[76] Inventor: Bernice Polsky, 139 N. Clark Dr., Beverly Hills, Calif. 90211

[21] Appl. No.: 221,318

[22] Filed: Dec. 29, 1980

[51] Int. Cl.[3] ..... A41D 1/06; A41B 9/04

[52] U.S. Cl. ..... 2/227; 2/407

[58] Field of Search ..... 2/227, 77–83, 2/401, 407, 409

[56] References Cited

U.S. PATENT DOCUMENTS

| | | | |
|---|---|---|---|
| 557,563 | 4/1896 | Dunning | 2/401 |
| 924,013 | 6/1909 | Stecker | 2/227 |
| 1,891,884 | 12/1932 | Tanner | 2/407 |
| 2,318,199 | 5/1943 | Clements | 2/407 |
| 2,651,047 | 9/1953 | Emerson | 2/407 |

FOREIGN PATENT DOCUMENTS

| | | | |
|---|---|---|---|
| 655354 | 1/1963 | Canada | 2/227 |

*Primary Examiner*—Doris L. Troutman

*Attorney, Agent, or Firm*—Spensley, Horn, Jubas & Lubitz

[57] ABSTRACT

A pants-like garment especially suitable for being worn while dancing, exercising or partaking in similar activities is described. The garment is form fitting in the buttocks and upper thigh areas but has no seams running along the crotch. An essentially curved diamond-shaped crotch piece with concave edges and long tapering sections which extend down the insides of the legs is sewn into the garment. The movement of a leg of a wearer of the garment which would otherwise cause the garment to ride up the crotch is transferred to the crotch piece in such a way that the force on the crotch piece in the area of the crotch is in the transverse direction, rather than in a direction along the crotch so that the garment therefore does not ride up the crotch. The elimination of seams on both the back and the front of the garment running along the crotch in the crotch direction, in addition to enhancing the comfort of the wearer, presents a more aesthetically pleasing appearance than is otherwise obtained, while the crotch piece itself allows room for the wearer without a loose or baggy appearance.

6 Claims, 4 Drawing Figures

SEAMLESS CROTCH

BACKGROUND OF THE INVENTION

1. Field of the Invention

The present invention relates to the field of pants-like garments, especially those designed to be worn as dancewear or for athletic exercise, or designed to be form-fitting in the buttocks and upper thigh areas.

2. Prior Art

Pants-like garments designed to be worn for dancing, skating or exercise are often form-fitting in the buttocks and upper leg areas. Typically, comfort is a problem in that various movements of the wearer tend to cause the garment to ride up in the area of the crotch. If, in order to remedy this, the point of the crotch of the garment is lowered to provide more room, the aesthetic qualities of a form-fitting garment are destroyed as the garment now appears to be loose and baggy in the area of the crotch.

Other problems related to comfort and aesthetics result from the location of seams along the crotch in the front and back. Aesthetically, a seam located along the front of a pants-like garment tends to draw the eye of an observer toward it and tends therefore to accentuate the genital area of the wearer. Also, both the front and the back crotch seams can become misaligned with respect to the center of the body, the crotch seams moving over either to the left or to the right side of the wearer during movements. This results in a particularly unpleasing aesthetic effect as well as necessitates efforts by the wearer to straighten the seams. In addition, the mere location of a seam along the crotch of the garment often results in discomfort to the wearer. This is especially true where the wearer must sit directly on the seam.

The problems associated with locating a seam along the crotch are accentuated by the fact that such a seam undergoes severe strains and must therefore be strong. A strong seam, even when the garment is made of stretchable material, generally allows little stretch along its length which is the very place in which the stretchability of the material used could be a factor in enhancing the comfort of the garment.

As has been mentioned, one approach in solving some of the above problems has been to provide more room in the crotch, with the result that the garment loses its aesthetically pleasing form-fitting appearance. Another approach has been to sew a gusset into the crotch area. Such a gusset is a small piece of material sewn in at the bottom of the crotch. The gusset may provide more room within the garment for the wearer, but it does not essentially solve the ride-up problem in the area of the crotch, and because it is not contoured to the body in the area of the crotch, does not result in a garment which is aesthetically pleasing as well as comfortable.

Gussets or similar structures are shown in U.S. Pat. No. 453,874 issued to West, U.S. Pat. No. 2,651,047 issued to Emerson, U.S. Pat. No. 3,392,733 issued to Blair, U.S. Pat. No. 2,250,218 issued to Cadous and U.S. Pat. No. 1,891,884 issued to Tanner. It is not believed that these patents show a gusset or similar structure which prevents the garment from riding up.

One approach that has been tried in order to prevent ride up in the crotch area is to sew into the crotch area two concentric swatches having their stretchability directions at right angles, such as is shown in U.S. Pat. No. 3,486,507 issued to Bregenzer, et al. This particular construction is conspicuous and tends to draw the eye of the observer to the crotch area.

The present invention takes a differnt approach in solving the aesthetic and comfort related problems discussed above, and to this end, provides a crotch piece having long tapering portions which run down the insides of the legs of the garment. Not only does the present invention solve the crotch ride-up problem and provide more comfort for the wearer but the use of the present invention provides a more aesthetically pleasing appearance and hence is suitably used in garments for dancing, skating, or exercise rather than being restricted to use in undergarments.

SUMMARY OF THE INVENTION

The present invention is useful for pants-like garments in which the legs of the garment extend at least to about the knee area.

An object of the present invention is to provide a form-fitting pants-like garment which is suitable for use as dance or athletic wear or the like and which is both more aesthetically pleasing and more comfortable than has heretofore been provided.

A garment using the present invention, therefore, has an essentially curved diamond-shaped crotch piece sewn into the crotch area. The crotch piece has long tapering points running down the insides of the legs of the garment as well as shorter points extending along the crotch between the front and the back.

The long tapering points of the crotch piece proceed down the inside of the legs so that the garment conforms as much as possible to the natural taper of the thighs while the extra room in the crotch area provided by the crotch piece is distributed over the crotch from the front to the back so that the garment does not appear to be loose or baggy when the wearer is not moving or exercising. As a result of its construction, a form fitting garment made in accordance with the present invention is aesthetically pleasing.

In conventional garments designed to be form-fitting the garment tends to ride up the crotch when the wearer moves one leg with respect to the other. For example, when one leg of the wearer is lifted straight in front of the person such as in a kicking motion, a downward pull is exerted on the back of the garment. This pull originates along the leg of the person and proceeds around the crotch and the buttocks to the back of the waist portion of the garment. The pull occurs because the back part of the garment must cover more area when the leg is so lifted so that the garment naturally tends to pull downward at the back of the waist and to ride up the crotch in order to compensate for the pull. In the present invention, the long tapering points of the crotch piece redirect the pulling forces in the crotch area. Since these points extend down the leg, the pull on them is in a direction along their lengths. However, on the crotch piece this direction is transverse to the crotch in the area of the crotch. Hence, the crotch piece is pulled across rather than down along the crotch, and therefore the garment does not ride up as do garments not employing the present invention. Thus, an object of the present invention, to provide a pants-like garment which does not ride up the crotch as a result of movement by the wearer, is achieved.

Furthermore, in the present invention there are no seams along the crotch either in the front or in the back, thus eliminating the discomforts and unaesthetic qualities associated with such seams as previously discussed.

Thus the present invention provides an aesthetically pleasing form-fitting appearance even when the wearer is not performing movements during the course of a dance or exercise routine.

DESCRIPTION OF THE PREFERRED EMBODIMENT

The present invention can be employed in dance or skating apparel, athletic clothing, undergarments such as body stockings and other garments having integral leg portions. The garments employing the present invention are generally form-fitting, but they need not be skin-tight in order that the present invention be successfully employed. The seamless crotch construction of the present invention enhances not only the aesthetics of the clothing with which it is used but it also significantly increases the comfort of the wearer.

The seamless crotch construction of the present invention can be used with any material which stretches in at least one direction, and may also be used with materials which stretch in all directions. The materials may be, for example, woven or knitted fabrics. The fabrics may be combinations of natural and synthetic fibers, and in particular a combination of cotton and lycra-spandex is one fabric which has been found to be suitable for use with the present invention. It is not intended, however, that the present invention be limited to that fabric or to any other particular type of fabric. So long as the crotch piece of the present invention is made from material stretchable in at least one direction, in fact, the rest of the garment may be made even of non-stretchable material.

Figure 1:
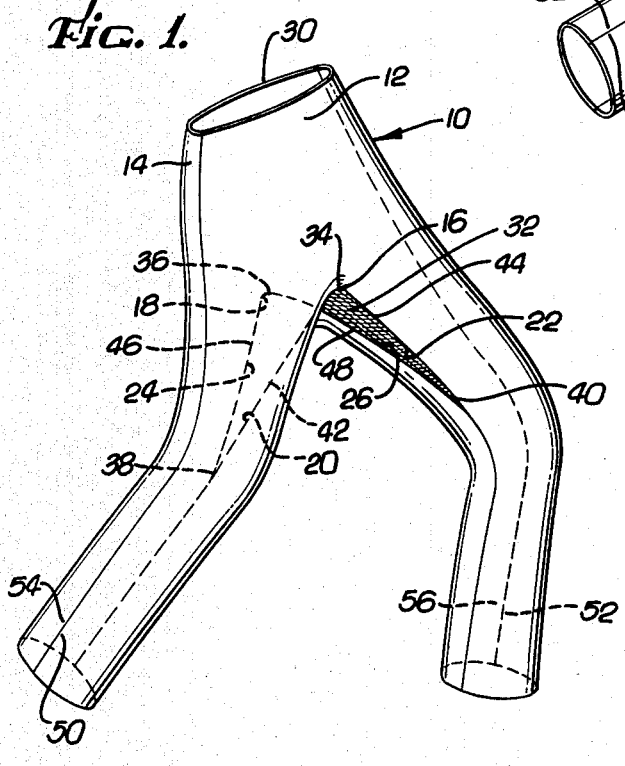
FIG. 1 is a perspective view of the device of the present invention.

A pants-like garment, such as shown in FIG. 1 will be described as a preferred embodiment of the present invention. For purposes of the present description, the pants-like garment 10 shown in FIG. 1 comprises three essential pieces of fabric, each formed of material stretchable in all directions. A front section 12 and a rear section 14 each having trunk and leg areas form the main part of the pants-like garment 10. The crotch points 16 and 18 of the front and rear sections 12 and 14 respectively at which the leg sections separate from the trunk are located higher up, i.e., nearer to the waist 30 then they are in conventional pants-type garments. This is because the remainder of the garment which proceeds around the crotch of the wearer is comprised of a third or crotch piece 32. Crotch piece 32 is a generally curved diamond-shaped piece of fabric having concave edges. The shorter points of the diamond form the front point 34 and the rear point 36 of the crotch piece and are connected respectively to the crotch point 16 on the front section 12 of the garment 10 and the crotch point 18 on the rear section 14 of the garment 10. The longer points 38 and 40 of the crotch piece 32 extend down the insides of the legs of the garment 10 and are attached to the inside edges 20 and 22 of the front section 12 and 24 and 26 of the rear section 14.

The construction of the seamless crotch of the present invention, in garments employing it, provides features of aesthetics and comfort heretofore unknown in form-fitting garments used for activities such as dancing, skating or exercising. It will be noticed, first, that the present invention does not have a seam along the crotch in either the front or the back areas. Particularly a seam located along the middle front of the garment draws attention to the genital area of the wearer. This may not be desirable in a form-fitting type of garment and a garment made in accordance with the present invention has no such seam. A seam located on the back of the garment is also aesthetically undesirable as it may be displaced either left or right of center during movements by the wearer. The elimination of seams along the crotch, especially on the back of the garment, also enhances the comfort of the wearer. The wearer of a garment made in accordance with the present invention, for example, rests his or her body, while in a sitting or reclining position on a flat expanse of material rather than on a seam which necessarily comprises a double layer of material.

While the present invention is generally form-fitting in the hips and upper leg areas, ample room is provided in the crotch area, but this is accomplished without the loose, baggy, or ill-fittiing effect characteristic of garments which have tried to provide a modicum of comfort in the crotch area. The crotch piece 32 has a direction of stretchability which runs in the direction between the front point 34 and the rear point 36 of the crotch piece 32 so that while this piece hangs below the crotch point 16 it does not appear to be baggy. This is because the natural focus for the eye is presented by the crotch point 16 located at a natural position for a crotch point rather than significantly lower than the actual crotch of the wearer, as is the case in other garments which provide room in the crotch area.

It will be noticed that the crotch piece 32 is large in the crotch area but quickly tapers down along its concave edges, to long tapering portions which conform to the shape of the thighs. This unique construction prevents the garment from riding-up the crotch of the wearer when the wearer moves his or her leg.

Figure 2:
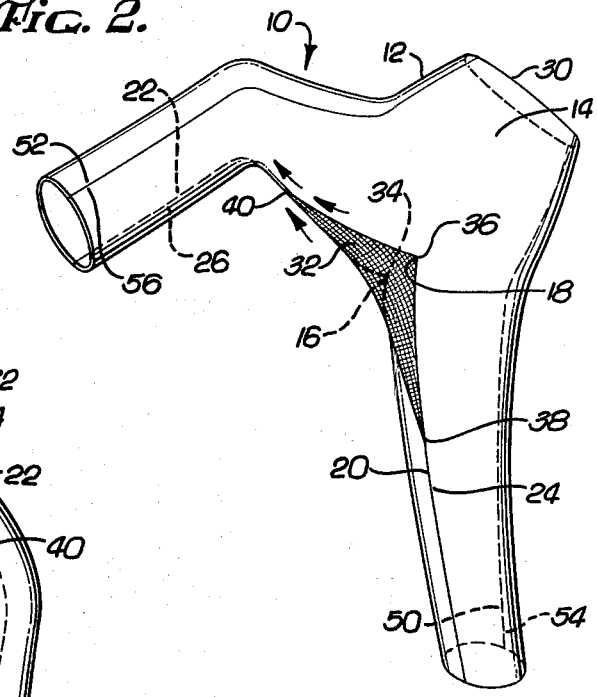
FIG. 2 is a perspective view of the device of the present invention particularly illustrating how the crotch piece does not ride up the crotch of the wearer.
Figure 3:
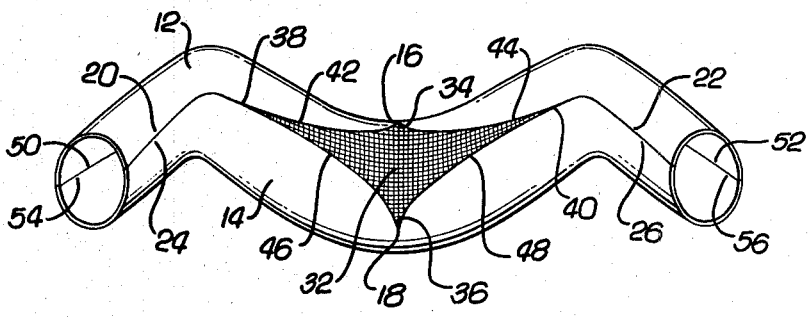
FIG. 3 is a perspective view of the device of the present invention looking from the bottom upward.

Thus, for example, when a person raises one of his or her legs, such as is shown in FIG. 2, even if the garment is not skin-tight or form-fitting, the garment will be pulled in a direction downward at the back of the waist area, this pull originating along the leg and proceeding around the crotch and buttocks to the waist of the garment. In the crotch area, a garment not using the present invention will tend to ride-up the crotch when subjected to such a pull. With the present invention however, the pull is transmitted to the crotch piece 32 through the seams joining the long tapering portion of the crotch piece 32 to the rest of the garment 10. This pull is generally in a direction along the long tapering portion, which, in the crotch area, is in a direction transverse to rather than along the crotch. The garment 10, therefore, is prevented from riding up the crotch and is thus more comfortable to the wearer. At the same time, the crotch piece 32 may stretch in the direction between the front point 34 and the rear point 36 to comfortably accommodate the wearer.

A more detailed description of the present invention will now be given with respect to FIGS. 1 through 4. The main part of the garment 10 is formed by the front section 12 and the rear section 14, each of which has trunk and leg areas. Each section 12 or 14 may be cut from a single piece of cloth with a direction of stretchability, if there is only one such direction, oriented perpendicular to the waist 30 of the front section 12 or rear section 14. Each said section 12 or 14 is generally shaped in the form of an inverted V, and has the general shape of a typical pair of pants viewed from the front or the rear. The inside edges 20 and 22 of the legs of the front section and 24 and 26 of the legs of the rear section 14 thus cut across the direction of stretchability if there is only one such direction.

The inside edges 20 and 22 of the front section 12 meet at a crotch point 16. The crotch point 16 is closer to the waist 30 on the front piece 12 then would be a crotch point on a front piece for a pair of pants which does not employ the present invention but consists merely of a front section and a rear section. The construction of the rear section 14 is very similar to the front section 12 except that the crotch point 18 is slightly closer to the waist 30 than is the crotch point 16 of the front piece 12.

Figure 4:
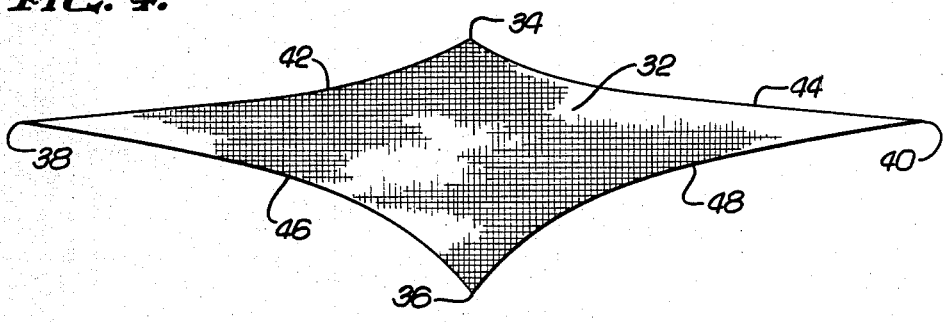
FIG. 4 is a pattern of the crotch piece.

As seen in FIG 4, the crotch piece 32 is of a generally elongated curved diamond-shape. The crotch piece 32 is formed of a single piece of cloth in which the direction of stretch, if there is only one such direction, is along the short or crotch axis of the diamond, i.e., between the front point 34 and the rear point 36. The edges 42, 44, 46 and 48 of the crotch piece 32 are all concave. In the preferred embodiment, the longitudinal axis of the crotch piece 31, i.e., the axis connecting the point 38 with the point 40 is approximately three to four times as long as the crotch axis between the front point 34 and the rear point 36. It will also be noticed that the front point 34 is a shorter less tapered point than is the rear point 36 of the crotch piece 32 with the longitudinal axis intersecting the crotch axis at a point which is closer to the front point 34 than to the rear point 36 by approximately a factor of two.

The front point 34 of the crotch piece 32 and its adjacent edges 42 and 44 are connected to the front section 12 while the rear point 36, and its adjacent edges 46 and 48 are connected to the rear section 14.

In particular, the front point 34 is attached to the crotch point 16 with the adjacent edge 42 of the crotch piece 32 attached along the inside edge 20 of the front section 12 and the adjacent edge 44 attached along the inside edge 22 of the front section 12.

The rear point 36 of the crotch piece 32 is attached to the crotch point 18 of the rear section 14 with the adjacent edge 46 attached along the inside edge 24 of the rear section 14 and the adjacent edge 48 attached along the inside edge 26 of the rear section 14.

In the construction of the crotch piece 32 as described, the concave edges 46 and 48 adjacent to the rear point 36 are slightly longer than the concave edges 42 and 44 adjacent to the front point 34. This difference in length compensates for the fact that the crotch point 18 of the rear section 14 is located higher up or nearer to the waist 30 than is the crotch point 16 of the front section 12, thus making the inside edges 24 and 26 of the rear section 14 slightly longer than the inside edges 20 and 22 of the front section 12. The difference in length between the inside edges 20 and 24 for one leg and 22 and 26 for the other is equal to the difference in length between the concave edges 46 and 42 on the one hand and 48 and 44 on the other. The result is that when the crotch piece 32 is attached to the front section 12 and rear section 14 as has been described, the distance from the points 38 and 40 of the crotch piece 32 to the bottom of the legs of the front section 12 is the same as that to the bottoms of the legs of the rear section 14. Below the points 38 and 40, therefore, the front section 12 and the rear section 14 can be attached to each other along the remainder of their inside edges 20 and 24 for one leg and 22 and 26 for the other leg. The construction of the garment 10 is completed by stitching the corresponding outside edges 50 of the front section 12 to 54 of the rear section 14 and 52 of the front section 12 to 56 of the rear section 14.

It will be appreciated that the shape and relative dimensions of the crotch piece 32 complement the natural shape and structure of the body in the area in which crotch piece 32 is used. Thus, the distance between the longitudinal axis of the crotch piece 32 and the rear point 36 is greater than that between the longitudinal axis and the front point 34 (and similarly the crotch point 18 of the rear section 14 is slightly closer to the waist 30 than the crotch point 16 of the front section 12), because the crotch area of the human body extends more rearward than forward when considered with respect to the center line of the insides of the legs. Similarly, the upper thigh of a person generally increases in circumference in the direction toward the trunk of the body. Thus, the crotch piece 32 has long tapering portions that run down the inside of the legs of the person wearing the garment. Yet, to cover the crotch area these tapering portions must appreciably widen in the area of the crotch. The concave edges 42, 44, 46 and 48 perform this function and result in a crotch piece 32 which is well suited for meeting the requirements set by the basic dimensions and shape of the upper thigh and trunk area of the body.

The characteristic of a garment having the above-described construction in not riding-up the crotch of a wearer can be seen with respect to FIG. 2. In a typical garment, an action by the wearer in which one leg moves with respect to the trunk area and to the other leg tends to exert a pull on the garment in the crotch and buttocks area. This is true because when the leg is so moved, such as shown in FIG. 2, the effective distance between the waist and the back of the knee, for example, measured along the contour of the body, increases. Even if the garment is not form-fitting in the lower part of the thigh or the knee area, as the knee is raised, such as is shown in FIG. 2, the garment acting in the knee and lower thigh area tends to pull on the upper part of the garment. In a conventional garment this pull is from the middle of the back of the waist around the buttocks and crotch area to the inside and back of the leg and down the leg. Thus, a movement such as is shown in FIG. 2 would tend to make a conventional garment ride-up the crotch. This effect, of course, is more pronounced if the garment is form-fitting or skin-tight along its entire length.

In a garment employing the above-described construction of a seamless crotch, however, the pull exerted on the garment along the leg portions is transmitted to the crotch piece 32 by the long tapering portions of the crotch piece and there is no crotch ride-up. This can be understood by reference to the arrows in FIG. 2. The seams where the inside edges 20 and 24 respectively meet the edges 42 and 46 of the crotch piece 32 form what are essentially discontinuities in the stretch pattern of the fabric of the garment. A pulling force exerted at a point on the seam is thus actually transmitted along a significant portion of the length of the seam so that the tapering portion of the crotch piece 32 is pulled generally in a direction along its longitudinal axis as shown by the arrows in FIG. 2. As this longitudinal axis in the area of the crotch is across the crotch, the pull on the crotch piece 32 is to a large extent across the crotch rather than along the crotch as in a conventional garment. Thus a garment employing the above-described construction of the present invention does not ride-up the crotch during leg movements.

It will be appreciated from the above description of a presently preferred embodiment that other configurations are possible and within the scope of the present invention. For example, while the preferred embodiment used material stretchable in both directions for the crotch piece, the front section and the rear section, it may be desirable to use material stretchable in one direction only or to use non-stretchable material for the front section and the rear section while using stretchable material for the crotch piece. Similarly, the preferred embodiment was described in terms of a pants-like garment similar to what is commonly referred to as exercise pants. However designs in which an integral top part is fabricated with the bottom part of a garment, such as apparel especially designed to be worn by dancers, are also within the scope of the present invention. Thus, the present invention is not intended to be limited to the particular embodiment specifically discussed hereinabove.

I claim:

1. A pants-like garment having leg portions and a trunk portion comprising:

a front piece having a trunk area and legs, the inside edges of said legs forming an inverted V and meeting said trunk area at a front piece crotch point;

a rear piece having a trunk area and legs, the inside edges of said legs forming an inverted V and meeting said trunk area at a rear piece crotch point; and a generally diamond-shaped crotch piece having concave edges and made of a stretchable material, said crotch piece having a front and a back portion terminating in a first and second point opposite to each other, said first and second points defining a crotch axis, and having long tapering leg portions terminating in third and fourth points opposite to each other, said third and fourth points defining a longitudinal axis, said longitudinal axis being at least twice as long as said crotch axis and intersecting said crotch axis at a point closer to said first point than to said second point, said crotch piece being stretchable along said crotch axis, said first point being joined to said front piece at said front piece crotch point, said second point being joined to said rear piece at said rear piece crotch point, said edges of said crotch piece adjacent said first point each being joined to an inside edge of said legs of said front piece, said edges of said crotch piece adjacent said second point each being joined to an inside edge of said legs of said rear piece, said inside edges of said legs of said front and rear pieces being joined together at said third and fourth points of said crotch piece and along their lengths to their bottoms, said front piece and said rear piece being joined together at the outside edges of said legs and trunk areas along their lengths, thereby forming a pants-like garment which conforms to the contours of the body in the trunk and upper leg areas, whereby said front and rear pieces cooperate with said crotch piece to pull said crotch piece away from the crotch area of a person when one leg of said person pulls on said garment.

2. A pants-like garment as in claim 1 wherein said front piece and said rear piece are each fabricated of material having at least one direction of stretchability.

3. A pants-like garment as in claim 1 or 2 wherein said rear piece crotch point is located slightly further from the bottom of said legs of said rear piece than said front piece crotch point is located from the bottom of said legs of said front piece.

4. A pants-like garment as in claim 1 or 2 wherein said longitudinal axis is between three and four times as long as said crotch axis and intersects said crotch axis at a point closer to said first point than to said second point by a factor of approximately two.

5. A pants-like garment as in claim 2 wherein said front piece, said rear piece and said crotch piece are each formed of material stretchable in all directions.

6. A pants-like garment as in claim 5 wherein said material is a blended combination of cotton and lycra-spandex.

* * * * *